United States Patent [19]

Coleman

[11] 4,335,378

[45] Jun. 15, 1982

[54] TIMED DUAL COMPARATOR ALARM

[75] Inventor: Charles Coleman, Lakewood, Colo.

[73] Assignee: Emerson Electric Company, St. Louis, Mo.

[21] Appl. No.: 971,510

[22] Filed: Dec. 20, 1978

[51] Int. Cl.[2] ..... G08B 17/10

[52] U.S. Cl. ..... 340/629; 250/381; 340/661; 340/529

[58] Field of Search ..... 340/629, 628, 661, 523, 340/529; 250/381, 382, 384, 385, 389, 390

[56] References Cited

U.S. PATENT DOCUMENTS 3,604,983 9/1971 Levin et al. ..... 361/95

4,163,226 7/1979 Ogawa ..... 340/629

*Primary Examiner*—John W. Caldwell, Sr.

*Assistant Examiner*—Daniel Myer

*Attorney, Agent, or Firm*—James E. Pittenger

[57] ABSTRACT

A combustion detection apparatus and method is provided for generating an alarm output when either a first alarm condition or a second alarm condition is present. A first alarm output is generated when a first predetermined concentration of combustion products is continuously present in a region being monitored for a preestablished period of time. A second alarm output is immediately generated when a second predetermined concentration of combustion products is present in the region being monitored. The second predetermined concentration of combustion products represents a relatively greater concentration of combustion products than the first predetermined concentration.

11 Claims, 4 Drawing Figures

10

ALARM HORN
52
54
46
OSCILLATOR CIRCUIT
38
40
42
56
50
48
44
DIGITAL COUNTER
INPUT
OUTPUT
RESET
36
34
32
V3
V2
V1
SECOND REFERENCE VOTAGE
FIRST REFERENCE VOTAGE
22
30
24
20
26
28
18
14
16
POWER SOURCE
+
−
12

TIMED DUAL COMPARATOR ALARM

DESCRIPTION

TECHNICAL FIELD

The present invention relates to a condition detecting apparatus and method and, in particular, to a fire and smoke detector that generates an alarm when a relatively small concentration of combustion products is continuously detected for a predetermined time period.

BACKGROUND ART

Heretofore, detectors of combustion products which incorporate ion chambers occasionally generated undesirable or false alarm signals. These unwanted signals indicated that a relatively minute percentage of combustion products was present in the atmosphere. This small percentage resulted from sources such as particles of combustion from a cigarette or the combustion products emitted during the normal process of cooking food. In addition to the relatively low percentage of combustion products generating a flase alarm, other noncombustion sources, such as high air velocity or high humidity, would occasionally generate a false alarm. Since it is not desirable to generate an alarm under these types of normal conditions, the ion chamber could be set so that a relatively greater percentage of combustion products would be required before the alarm is triggered. However, this approach is unsatisfactory since it is essential that combustion products resulting from a smoldering fire be detected. Since a smoldering fire emits a relatively small concentration of combustion products, its presence would not be detected by an ion chamber set to generate an alarm only when a relatively greater concentration of combustion products is present. Therefore, to permit the ion chamber to generate an alarm when a relatively small percentage of combustion products is present in the atmosphere and still avoid an undesirable alarm resulting from the presence of conditions such as increased air velocity or high humidity, the invention described herein is provided.

SUMMARY OF THE INVENTION

In accordance with this invention, an ion chamber for detecting combustion products and generating a signal representative thereof is provided. A comparing circuit in combination with a timing circuit are responsive to this signal to indicate whether one of three conditions is present and in which two of the three conditions generate an alarm. If a first or safe condition is present, no alarm signal is generated. If a second or dangerous condition is present, an alarm signal is immediately generated. If a third or intermediate condition is present, and the third condition continues for a predetermined time period, an alarm signal is generated at the end of the predetermined period of time.

More particularly, the present invention comprises a power source having terminals connected to an ion chamber which includes an ion source. The ion chamber also includes an active chamber which is relatively exposed to the atmosphere and a reference chamber which is relatively closed to the atmosphere. Each of the chambers includes a pair of spaced electrodes or the chambers may share a common electrode. The chambers are in series to form a voltage divider so that when voltage is applied across the chambers, a current flow is generated through the chambers by movement of ions between the electrodes. When an ion chamber utilizing a common electrode is provided, the voltage potential at the common electrode is in accordance with the relative impedances of the active and reference chambers. When smoke or other particles of combustion are in the atmosphere and being sensed by the ion chamber, these combustion products effectively reduce current flow in the open active chamber in accordance with their concentrations. The impedance of the active chamber is thereby increased and the voltage potential at the common electrode changes. A dual comparing circuit including a pair of voltage comparators is responsive to this potential change. Each voltage comparator receives a reference voltage signal, together with the potential at the common electrode of the ion chamber. A first preselected reference voltage is applied to a first voltage comparator. The output of the first voltage comparator is applied to the RESET pin of a digital counter. The digital counter receives pulses from an oscillator circuit and counts the number of pulses inputted thereto. If the potential at the common electrode of the ion chamber is greater than the first reference voltage, the first comparator outputs a logic HIGH to the RESET pin of the digital counter. This logic HIGH resets and holds the count of the digital counter to zero. Alternatively, if the potential at the common electrode is less than the first preselected reference voltage, the output of the first comparator is a logic LOW. This logic LOW at the RESET pin of the digital counter is unable to reset the count contained therein to zero. The counter, then, continues to count the clock pulses received. The number of pulses counted corresponds to a particular period of time. During the time the output of the first comparator is a logic LOW, the digital counter continues to count the clock pulses. If a predetermined number of pulses are counted corresponding to a preselected period of time, a logic HIGH is outputted by the digital counter to an alarm circuit, indicating that combustion products are present. However, if during the counting process, the common electrode voltage becomes greater than the first preselected reference voltage, the digital counter is reset. Before the output of the digital counter can output a logic HIGH, then, the first reference voltage must exceed the ion chamber potential for a continuous period of time corresponding to a preselected number of clock pulses received by the digital counter.

A second preselected reference voltage is applied to a second voltage comparator. If the potential of the common electrode of the ion chamber is greater than this second reference voltage, a logic LOW is present at the output of the second voltage comparator indicating that a predetermined concentration of combustion products is not present in the region being monitored by the ion chamber. Alternatively, if the potential at the common electrode is less than the second preselected reference voltage level, the output of the second voltage comparator is a logic HIGH indicating that a second predetermined concentration of combustion products is present. This logic HIGH is applied to enable an alarm circuit which provides an indication that combustion products have been detected.

Accordingly, a combustion products detector is provided that produces an alarm signal when two different conditions are present. Whenever the potential of the ion chamber is less than first preselected reference voltage and remains at that potential for a predetermined time period, an alarm signal is generated indicating that a first predetermined concentration of combustion products is present in the atmosphere. Whenever the potential of the ion chamber is less than a second preselected reference voltage, which is less in absolute magnitude than the first preselected reference voltage, an alarm signal is immediately generated indicating that there is a second concentration of combustion products in the atmosphere. It can be appreciated that the detector of this invention is able to distinguish between alarm producing sources so that only a true alarm is generated. Furthermore, it is understandable that additional circuitry could be included in the detector to provide a perceptible indication of which of the two conditions generated the alarm signal. The possibility of generating an alarm because of transient alarm generating conditions such as increased air velocity or the smoke emitted during a normal cooking process would be substantially reduced since these conditions are present in the atmosphere for only a relatively short period of time. In addition, these conditions would not reduce the ion chamber potential below the reference voltage associated with the second voltage comparator that immediately generates an alarm signal since these conditions do not produce a sufficiently large concentration of combustion products. Contrastingly, a smoldering fire remains for a relatively long period of time but may not produce a relatively high concentration of combustion products. Thus, the first voltage comparator and timing circuit of this invention will monitor this condition and generate an alarm after a continuous preestablished period of time.

Additional advantages of this invention will be readily apparent taken in conjunction with the accompanying drawings.

BEST MODE FOR CARRYING OUT THE INVENTION

Figure 1:
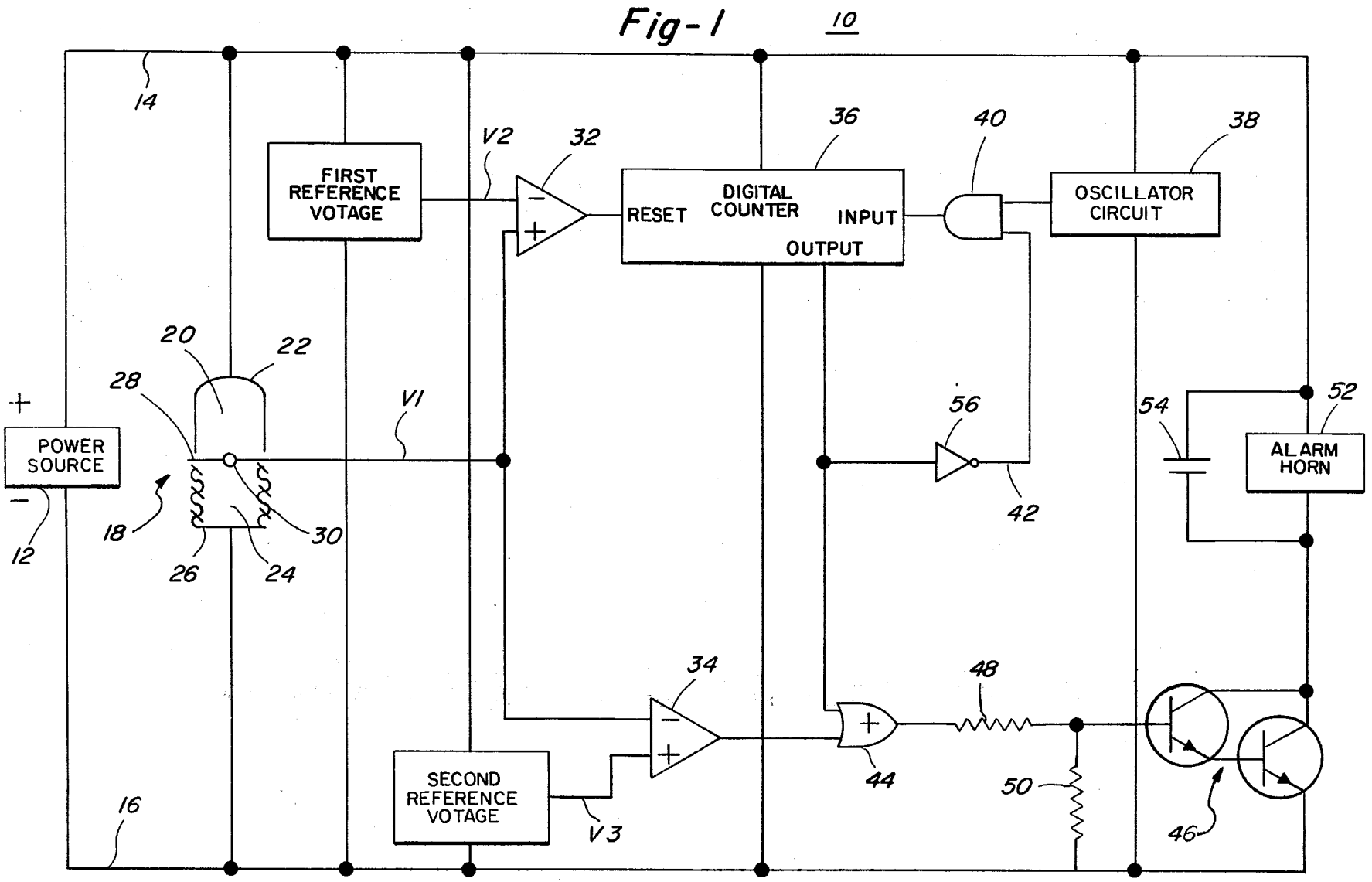
FIG. 1 is a circuit diagram of a combustion products detection apparatus according to this invention.

Referring to FIG. 1, a combustion products detector 10 is illustrated. The detector 10 is powered by a power source 12 which has a pair of output terminals connected to conductor lines 14 and 16 which conduct the power to the circuit element of detector 10. The power source 12 may be a battery voltage source which supplies a constant DC voltage or an AC voltage source typically in series with a diode which halfwave rectifies the AC voltage in parallel with a capacitor to smooth the voltage ripples. A zener diode is also typically provided for regulating the voltage between the conductor lines 14 and 16.

A double ion chamber 18 is provided for sensing the presence of combustion products in the atmosphere. Ion chamber 18 includes an active chamber 20 having an electrode 22 and a reference chamber 24 having an electrode 26 is connected across power source 12. As seen in FIG. 1, electrode 28 is common to both chambers and is spaced between electrodes 22 and 26. A radioactive source 30, positioned within a passage through common electrode 28, is provided for ionizing air molecules within both of the chambers 20 and 24. A sensed signal or voltage V1 of common electrode 28 is at a nominal potential when there are no products of combustion, such as smoke, entering the relatively open active chamber 20. When combustion products are present in the region being monitored by ion chamber 18, V1 changes proportionately in magnitude according to the concentration of combustion products in the active chamber 20. Since the impedance of the active chamber 20 increases with greater concentrations of smoke particles, V1 correspondingly decreases. The voltage V1 at the common electrode 28 is, then, inversely proportional to the percentage or concentration of combustion products in the air.

Common electrode 28 is connected to a first comparator 32 at its non-inverting terminal and a second comparator 34 at its inverting terminal. A first preselected reference voltage V2 is applied to comparator 32 at its inverting terminal. V2 is selected when detector 10 is constructed and is less in absolute magnitude than the nominal potential of common electrode 28. V2 may typically be provided by means of resistors in series forming a voltage divider. A second preselected reference voltage V3 is applied to comparator 34 at its non-inverting terminal. V3 is also selected when detector 10 is constructed and is also less in absolute magnitude than the nominal potential at common electrode 28. V3 is also less in absolute magnitude than preselected reference voltage V2 and may be typically provided by means of resistors in series forming a voltage divider.

Comparators 32 and 34 are devices that compare the inputs entering the inverting and non-inverting terminals and output either a logic HIGH or a logic LOW. A logic HIGH is generated if the input at the non-inverting terminal is greater than the input at the inverting terminal. Alternatively, a logic LOW is generated if the input at the non-inverting terminal is less than the input at the inverting terminal.

The output signal of comparator 32 is sent to the RESET pin of a digital counter 36. An oscillator circuit or clock 38 generates continuous pulses which are received by AND gate 40. If a counter feedback signal 42 is a logic HIGH, the clock pulses are gated to the counter input pin. Digital counter 36 then counts the number of pulses. If, however, a logic HIGH is present at the RESET pin of the digital counter 36, the count is reset to zero and remains in the zero state while the logic HIGH is present.

Oscillator circuit 38 may be arranged so that a pulse is sent to the clock input pin of digital counter 36 once every second. The count of digital counter 36 then corresponds to the number of seconds elapsed since the counter was previously reset by a logic HIGH from first comparator 32. Alternatively, oscillator circuit 38 may be arranged to produce pulses at any desirable frequency and the digital counter 36 accordingly arranged to monitor the clock pulses at this selected frequency. It being necessary that at the completion of a preestablished time period, which corresponds to a set number of pulses at the selected frequency, a logic HIGH is applied from counter 36 to the input pin of OR gate 44. When a logic HIGH is applied to OR gate 44, transistor control circuit 46, which includes fixed resistors 48 and 50, conducts. In this condition, an alarm horn 52, which is being shunted by capacitor 54, produces a perceptible signal. When a logic LOW is applied to both inputs of OR gate 44, control circuit 46 does not conduct or is shut off. In this condition, alarm horn 52 does not generate a perceptible signal.

An inverter 56 is also connected to the output of digital counter 36. If a logic LOW is sent to inverter 56, counter feedback signal 42 is a logic HIGH which enables AND gate 40 and consequently counter 36 receives the clock pulses on its input pin.

The output signal of second comparator 34 is sent directly to OR gate 44. As previously described, a perceptible signal may be produced by alarm horn 52 depending on whether a logic HIGH is sent by second comparator 34 or a logic LOW is present on both inputs to OR gate 44.

When a first predetermined concentration of combustion products enters active chamber 20, the nominal voltage at the common electrode 28 becomes less than the value of a first preselected reference voltage V2 at the input of first comparator 32. The output of first comparator 32 becomes a logic LOW since V2 is greater than V1. This logic LOW is applied to the RESET pin of digital counter 36 so that the count in digital counter 36 is not reset to zero while the logic LOW is present, that is, during the time V2 is greater than V1. The pulses at the output of oscillator circuit 38 are then gated into the input pin of digital counter 36 through AND gate 40. Counter 36 continues to count the pulses received until a preselected number of pulses have been counted. This preselected number of pulses corresponds to a preestablished period of time. After a preestablished period of time, digital counter 36 outputs a logic HIGH to OR gate 44. Consequently, a logic HIGH is present at the output of OR gate 44 which enables transistor control circuit 46 to conduct and thereby causes alarm horn 52 to energize. In addition to the logic HIGH of digital counter 36 being sent to OR gate 44, this logic HIGH is also gated through the inverter 56 so that the counter feedback signal 42 becomes a logic LOW. This feedback signal 42 is applied to AND gate 40. Since this signal becomes a logic LOW once the preestablished time period has been completed, AND gate 40 is inhibited and the clock pulses from oscillator circuit 38 are prevented from being inputted into digital counter 36. Thus, the output of digital counter 36 remains a logic HIGH and the alarm signal continues as long as V2 is greater than V1. It can be appreciated that during the time digital counter 36 continues to count clock pulses entering therein, the output of digital counter 36 is a logic LOW so that the output of inverter 56 is a logic HIGH thereby enabling AND gate 40 which sends the clock pulses into the input of counter 36. It can also be understood that if the concentration or percentage of combustion products present in the atmosphere becomes less than the first predetermined concentration of combustion products, that is, V1 is greater than V2, then a logic HIGH from first comparator 32 resets the counter 36. If V2 again becomes greater than V1, digital counter 36 must begin to count again from zero. Thus, the preestablished time period must again be completed before a logic HIGH is present at the output of digital counter 36.

Understandably, reference voltage V2 may be selected to be any value less in absolute magnitude than the nominal voltage of ion chamber 18 at common electrode 28, but greater than a second preselected reference voltage V3, which is applied to the non-inverting terminal of second comparator 34, so that an operable detector is provided in accordance with this invention. As the value of V2 approaches the value of the nominal potential of ion chamber 18, the sensitivity of detector 10 to products of combustion in the area being monitored is greatly increased, that is, a relatively low concentration of combustion products present in the atmosphere over a preestablished continuous period of time will be detected and an alarm produced. Additionally, the number of clock pulses counted by digital counter 36 before a logic HIGH is outputted can also be selectively varied. If a shorter time period is desired before an alarm condition is generated when the first predetermined concentration of combustion products is present, then a relatively fewer number of pulses are counted by counter 36 before the logic HIGH output is generated. Alternatively, if a longer time period is desired before an alarm condition is generated when the first predetermined concentration of combustion products is present, then a relatively greater number of pulses are counted by counter 36 before the logic HIGH output is generated. It can also be appreciated that circuitry could be provided in detector 10 to produce a perceptible signal indicating that counter 36 is counting pulses inputted thereto from oscillator circuit 38. This feature would provide an indication forewarning the possible presence of a smoldering fire condition.

Figure 2:
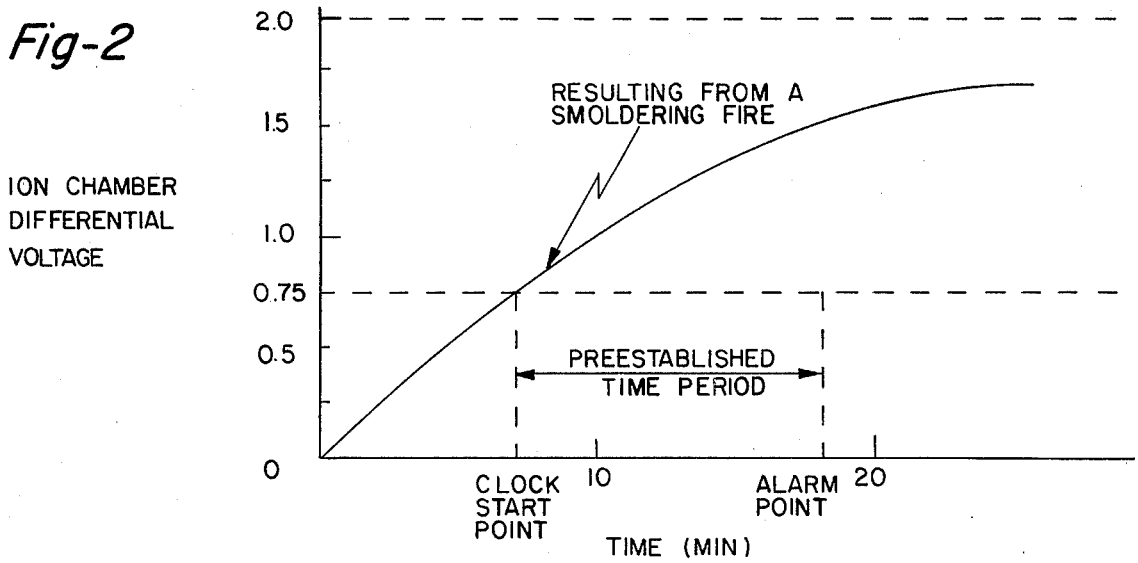
FIG. 2 is a graph showing a plot of ion chamber differential output voltage versus time for a relatively low concentration of combustion products in the atmosphere.
Figure 3:
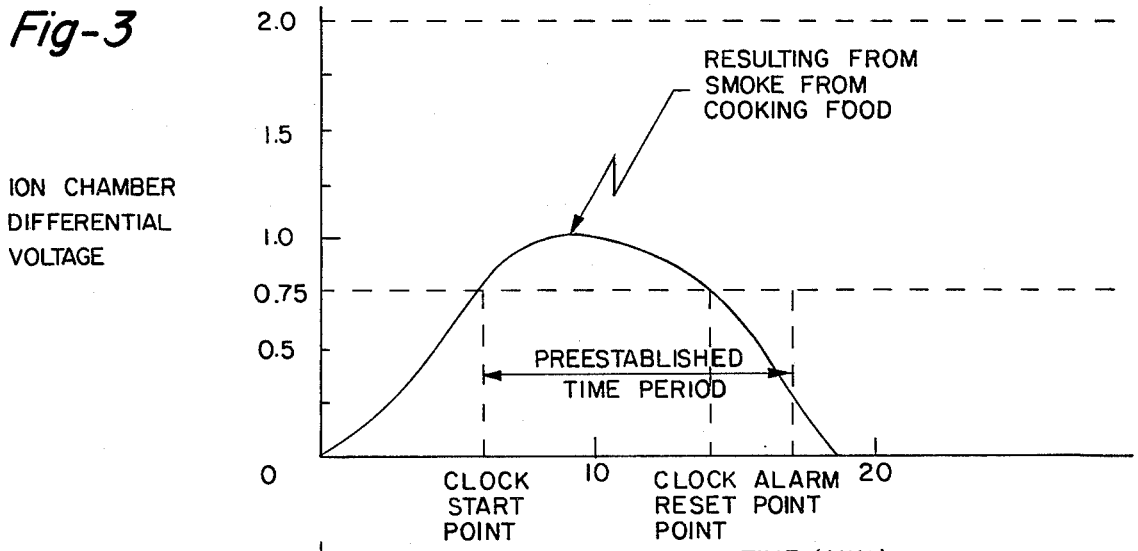
FIG. 3 is a graph showing a plot similar to FIG. 2 but showing a relatively low concentration of combustion products remaining in the atmosphere for a relatively short period of time.

The presence of at least a first predetermined concentration of combustion products for a preestablished period of time in the region being monitored is graphically illustrated in FIG. 2. A plot of ion chamber differential output voltage which equals the mathematical difference between the value of the nominal voltage potential of common electrode 28 and the value of the voltage of common electrode 28 when products of combustion are present, versus time is shown. At an acceptable differential voltage, for example, 0.75 volts as shown in the graph which corresponds to a first predetermined or relatively low concentration of combustion products present in the region being monitored, the digital counter 36 begins to count clock pulses since the first comparator 32 now outputs a logic LOW. Since the curve of FIG. 2 represents a smoldering fire condition with the chamber differential output voltage remaining greater than 0.75 volts, the counter continues to count clock pulses until a preestablished period of time is completed. Although many different time periods may be chosen, FIG. 2 depicts a preestablished time period of approximately ten minutes since it has been found to be an acceptable time inasmuch as substantially all transient undesirable alarm-producing conditions are not present for ten minutes. A transient possible alarm generating condition is illustrated by the curve of FIG. 3. As can be seen, the ion chamber differential output voltage does not remain greater than 0.75 volts for the entire preestablished time period of ten minutes. Although high humidity from a shower or bath or smoke from the cooking of food, for example, may initiate the counting of clock pulses by digital counter 36, the counter is reset before the end of the preestablished time period is reached. Thus, no alarm point is met and no perceptible indication of an alarm condition is indicated.

When a second predetermined concentration of combustion products enters active chamber 20, the nominal voltage at the common electrode 28 decreases so that V1 becomes less than the value of the second preselected reference voltage V3 which is inputted to the second comparator 34. The value of the second reference voltage is selected to be less than the first reference voltage V2. After comparing V1 and V3 then, the output of second comparator 34 is a logic HIGH. This logic HIGH is inputted to OR gate 44 which subsequently provides a logic HIGH at the base of the control circuit 46. This logic HIGH enables the control circuit 46 to conduct thereby resulting in the energization of alarm horn 52. Alarm horn 52 will remain energized as long as the second predetermined concentration of combustion products is detected by the ion chamber 18, that is, during the time V3 is greater than V1. Thus, a perceptible signal is generated by alarm horn 52 to indicate that an alarm condition has been detected by detector 10. Understandably, the reference voltage V3 may be selected to be any value less in absolute magnitude than both the nominal voltage at common electrode 28 of ion chamber 18 and the first reference voltage V2. As the selection of the value of V3 approaches the nominal potential of ion chamber 18, the detector becomes more sensitized to combustion products in the atmosphere. A relatively lower concentration of combustion products would therefore generate an alarm. Alternatively, selecting values of V3 having a larger disparity with respect to V1 would require a relatively higher concentration of combustion products before an alarm is generated through second comparator 34.

Figure 4:
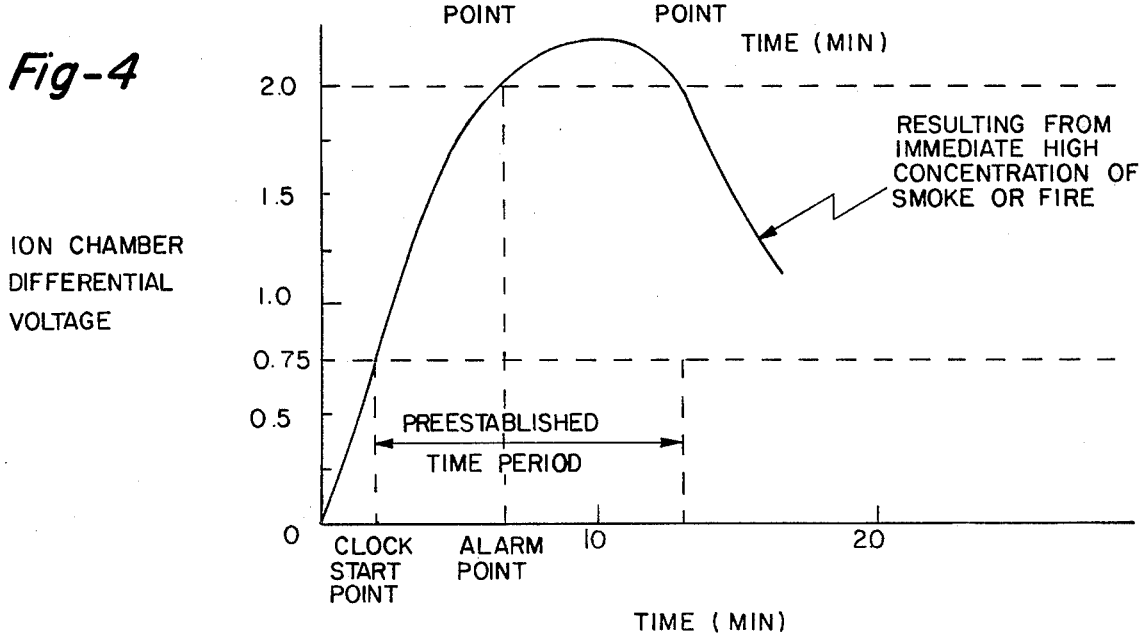
FIG. 4 is a graph similar to the plot of FIG. 2, but showing a relatively high concentration of combustion products in the atmosphere.

The presence of at least a second predetermined concentration of combustion products in the region being monitored is graphically illustrated in FIG. 4. FIG. 4, like FIGS. 2 and 3, depicts the voltage change due to the change in the concentration of combustion products present in the region being monitored by detector 10 from a condition in which no particles of combustion are present to conditions when combustion products are being detected. Unlike FIGS. 2 and 3, the curve of FIG. 4 represents the condition when a relatively high or second predetermined concentration of combustion products is present. In the example of FIG. 4, a chamber output differential voltage of two volts corresponds to such a concentration. As can be seen, a clock start point is reached but the alarm point, represented as a chamber differential voltage of two volts, is met prior to the end of the preestablished time period and an immediate alarm is provided since second comparator 34 and OR gate 44 are both a logic HIGH. Although the counter may count the number of clock pulses corresponding to the preestablished time period, if at least a 0.75 volt chamber output voltage is sensed, the alarm will continue regardless of the number of pulses counted by the counter 36 as long as the chamber output voltage is greater than two volts. If, however, the ion chamber output voltage becomes less than two volts, the alarm is inhibited since the second comparator 34 and OR gate 44 are both a logic LOW. But, if the chamber output voltage remains greater than 0.75 volts for the preestablished period of time and continues above this voltage level, the alarm will remain even though the ion chamber voltage is less than two volts.

Although the above-described embodiment provides a particular operable detector, it can be appreciated that a number of different component arragements or substitutions thereof can be made to provide the features of this invention. For example, although a digital counter is described herein, substitution of this digital counter timing arrangement with other timer circuits such as gated oscillators, single shots, and RC time constants is within the scope of this invention. Further, the dual comparator arrangement previously described may be changed to a single comparator. In cooperation with the appropriate digital logic gates, reference voltages V2 and V3 may be alternately applied or switched to one input terminal of the single comparator while V1 is constantly applied to the second terminal. The output of the comparator is then sent to a latch which retains the results of the comparison. Yet another arrangement is to make the voltage V3 a function of time. At preestablished time periods, a read only memory (ROM) would respond to the particular output of a counter by applying a digital signal representing a different reference voltage to a digital-to-analog (D/A) converter. The output of the D/A converter would be subsequently sent to an input terminal of a comparator while the ion chamber potential is sent to the other terminal. This arrangement provides the capability of detecting a preselected rate of increase in the concentration of combustion products. Even though only a few variations of the particular embodiment illustrated in the drawings have been described, it can be appreciated that there are a considerable number of other possible component arrangements.

From the foregoing, an apparatus and a method for detecting predetermined concentrations of particles of combustion present in the atmosphere have been provided. An alarm is immediately generated when a relatively greater concentration of combustion products is detected. Significantly, an alarm is also generated when a relatively lower concentration of combustion products is present over a continuous preestablished period of time. Thus, when a smoldering fire is present, the detector of this invention would indicate an alarm condition. Furthermore, the detector of this invention is able to distinguish between the smoldering fire type of condition and such transient conditions as increased air velocity which would likely produce an alarm if the time delay embodied in this detector were not provided.

In addition to detecting combustion products, the invention described herein may be utilized in a multitude of applications. For example, a detector including the features of this invention, could be used to indicate the presence of an intruder. Since it is desirable that no alarm signal be generated when an intruder is not present, the first comparator and timing circuit of this invention would be used to assure that an intruder is present, rather than a drift in the value of the first preselected reference signal, for example, which may result in a false alarm being generated. Furthermore, when the presence of an intruder is immediately detected, the second comparator would be used to provide an immediate alarm.

The invention has been described in detail with particular reference to a plurality of embodiments thereof, but it will be understood that variations and modifications can be affected within the spirit and scope of this invention.

I claim:

1. A combustion products detection apparatus, comprising:

sensing means for monitoring the concentration of combustion products in a region to be monitored and generating a sensed signal corresponding to the concentration;

first comparator means for comparing the sensed signal with a first reference signal and generating a first output indicating whether at least a first predetermined concentration of combustion products is present in the region to be monitored;

second comparator means for comparing said sensed signal with a second reference signal and generating a second output indicating whether at least a second predetermined concentration of combustion products is present in the region to be monitored, the second predetermined concentration of combustion products being greater in magnitude than the first predetermined concentration of combustion products;

timing means responsive to said first comparator means for monitoring the continuous time elapsed while at least the first predetermined concentration of combustion products is present in the region to be monitored; and alarm means responsive to said timing means for producing a perceptible alarm signal when the first predetermined concentration of combustion products is sensed by said sensing means for a continuous preestablished period of time and for producing a perceptible output signal when the second predetermined concentration of combustion is present in the region to be monitored.

2. The apparatus, as claimed in claim 1, wherein:

the absolute magnitude of the first reference signal exceeds the sensed signal when the first predetermined concentration of combustion products is present in the region to be monitored.

3. The apparatus, as claimed in claim 1, wherein:

said timing means is responsive to said first comparator means and only monitors the time when the first predetermined concentration of combustion products is present in the region to be monitored.

4. The apparatus, as claimed in claim 1, wherein:

the sensed signal and the first reference signal are voltage signals.

5. The apparatus, as claimed in claim 1, wherein:

said sensing means includes ion chamber means.

6. The apparatus, as claimed in claim 1, wherein:

the first reference signal is greater in absolute magnitude than the second reference signal.

7. The apparatus, as claimed in claim 1, wherein said timing means includes:

clock means for generating pulses at a predetermined rate; and counter means for counting the number of pulses received from said clock means and providing an output indicating that a preselected count is reached, wherein the preselected count corresponds to a preestablished period of time.

8. A combustion products detection apparatus comprising:

a source of electrical power;

sensing means connected to said power source for monitoring the concentration of particles of combustion in a region to be monitored and providing a sensed signal representative of said concentration;

means for producing a first reference signal corresponding to a first predetermined concentration of combustion products;

means for producing a second reference signal less in magnitude than the first reference signal and corresponding to a second predetermined concentration of combustion products, the second predetermined concentration of combustion products being greater in magnitude than the first predetermined concentration of combustion products;

first comparator means responsive to the first reference signal producing means and the sensed signal for comparing the sensed signal and the second reference signal and providing a second output indicating whether the second reference signal exceeds the first signal;

oscillator means for generating pulses at a preestablished rate;

counting means responsive to the first output of said first comparator means and said oscillator means to count the clock pulses generated by said oscillator means when at least the first predetermined concentration of combustion products is present in the region to be monitored; and alarm means responsive to said timing means and said second comparator means for producing a perceptible alarm signal when the first predetermined concentration of combustion products is continuously present for a preestablished period of time in the region to be monitored and for immediately producing a perceptible output when the second predetermined concentration of combustion products is present in the region to be monitored.

9. A method for detecting the presence of a relatively low concentration of combustion products and generating an alarm indicating such while distinguishing the detection of combustion products from the detection of transient conditions present in the region to be monitored, said method comprising the steps of:

selecting a first reference signal representing a first predetermined concentration of combustion products;

selecting a second reference signal representing a second predetermined concentration of combustion products, the second predetermined concentration of combustion products being greater in magnitude than the first predetermined concentration of combustion products;

generating a second signal representing the concentration of combustion products in the region to be monitored;

comparing the sensed signal with the first reference signal to determine whether at least a first predetermined concentration of combustion products is present;

comparing the sensed signal with the second reference signal to determine whether at least the second predetermined concentration of combustion products is present in the region to be monitored;

delaying for a period of time when at least the first predetermined concentration of combustion products is present; and providing an alarm at the completion of the delaying step when the first predetermined concentration of combustion products is continuously present during the delaying step or providing an alarm when the second predetermined concentration of combustion products is present.

10. The method, as claimed in claim 9, wherein:

the first reference signal and the sensed signal are voltage signals and the sensed signal is inversely proportional to the concentration of combustion products in the region to be monitored.

11. The method, as claimed in claim 10, wherein:

the delaying step is initiated when the first reference voltage signal exceeds the sensed voltage signal.

* * * * *